US006202213B1

(12) United States Patent
Georgick

(10) Patent No.: US 6,202,213 B1
(45) Date of Patent: Mar. 20, 2001

(54) BOXING GLOVE WITH INFLATABLE WRIST CUFF

(76) Inventor: John J. Georgick, 822 Kerr St., Ambridge, PA (US) 15003

( * ) Notice: Subject to any disclaimer, the term of this patent is extended or adjusted under 35 U.S.C. 154(b) by 0 days.

(21) Appl. No.: 09/613,401

(22) Filed: Jul. 11, 2000

Related U.S. Application Data

(60) Provisional application No. 60/152,381, filed on Sep. 3, 1999.

(51) Int. Cl.[7] ..... A41D 13/08

(52) U.S. Cl. ..... 2/18; 2/161.1; 2/162

(58) Field of Search ..... 2/16, 18, 159, 2/161.1, 161.6, 162, 164, 338, 170, DIG. 3; 446/267; 602/13

(56) References Cited

U.S. PATENT DOCUMENTS

| | | | | |
|---|---|---|---|---|
| 320,972 | | 6/1885 | Rumsey . | |
| 2,582,648 | * | 1/1952 | Mowbray | 2/DIG. 3 |
| 2,653,319 | * | 9/1953 | Seizus | 2/18 |
| 2,817,088 | | 12/1957 | Vrana | 2/18 |
| 2,826,757 | * | 3/1958 | Urana | 2/18 |
| 3,247,520 | * | 4/1966 | Slizus | 2/18 |
| 3,755,820 | * | 9/1973 | Petrusek | 2/18 |
| 4,547,919 | | 10/1985 | Wang | 5/455 |
| 5,155,866 | | 10/1992 | Walker et al. | 2/18 |
| 5,309,573 | | 5/1994 | Solar et al. | 2/160 |
| 5,603,118 | | 2/1997 | Solomon | 2/20 |
| 5,638,550 | * | 6/1997 | Hube | 2/311 |
| 6,014,770 | * | 1/2000 | Spector | 2/18 |

* cited by examiner

*Primary Examiner*—Danny Worrell
(74) *Attorney, Agent, or Firm*—Webb Ziesenheim Logsdon Orkin & Hanson, P.C.

(57) ABSTRACT

A boxing glove includes a glove body defining a hand-receiving part for receiving a hand enclosed therein and a wrist-receiving part in communication with the hand-receiving part. The wrist-receiving part has a mouth opposite the hand-receiving part. The wrist-receiving part is configured to allow the hand to pass therethrough between the hand-receiving part and the mouth. The wrist-receiving part is configured to enclose the wrist of the hand when the hand is received in the hand-receiving part. The wrist-receiving part includes a slot defined by a pair of opposed sides which extend from the mouth toward the hand-receiving part. A pneumatic wrap is in contact with the glove body adjacent the pair of opposed sides for urging the opposed sides together when the pneumatic wrap is inflated.

20 Claims, 5 Drawing Sheets

BOXING GLOVE WITH INFLATABLE WRIST CUFF

CROSS REFERENCE TO RELATED APPLICATION

This application claims priority from U.S. Provisional Patent Application Serial. No. 60/152,381, filed Sep. 3, 1999 entitled "Boxing Glove with Inflatable Wrist Cuff".

BACKGROUND OF THE INVENTION

1. Field of the Invention

The present invention relates to boxing gloves and, more particularly, to boxing gloves which utilize a pneumatic wrap to secure the boxing glove to a hand.

2. Background Art

A conventional boxing glove, shown in FIGS. 1*a*–2*b*, is secured to a fighter's hand and wrist by a simple lace-type system which is well known in the art. In use, after each lace is tightened and the lace ends are tied, tape, such as surgical tape, is wrapped around the wrist-receiving part of the glove and the lace to provide both a tighter securing of the glove to the hand and wrist, as well as to ensure the lace remains on or adjacent the glove thereby avoiding a loose lace from potentially striking an opponents face or eye.

During the course of a fight, however, this tape often comes loose, thereby necessitating a temporary stop to the fight to re-secure the tape. This is a problem because the loose tape can be inadvertently flicked into the opponent's face or eye. Moreover, the loose tape may permit a portion of the lace to become separated from the glove, whereby it to can also be inadvertently flicked into the opponents face or eye.

It is, therefore, an object of the present invention to overcome the above problems and others by providing a boxing glove which can be secured to the hand and wrist of a fighter without lace and/or tape. It is also an object of the present invention to avoid the use of tape with a lace-secured boxing glove by providing a sleeve which can be secured around the wrist-receiving part and lace of the boxing glove to maintain the lace secured against the boxing glove. Still other objects of the present invention will become apparent to those of ordinary skill in the art upon reading and understanding the following detailed description.

SUMMARY OF THE INVENTION

Accordingly, I have invented a boxing glove which includes a hand part having a palm compartment in communication with a finger compartment and a thumb compartment. The palm compartment is configured to receive and enclose a palm part and a dorsal part of a hand. The finger compartment and the thumb compartment are configured to receive and separately enclose the respective fingers and thumb of the hand. The boxing glove includes an elongated wrist-receiving part configured to receive and enclose a wrist of the hand received in the hand part. The wrist-receiving part extends away from the side of the palm compartment opposite the finger compartment and terminates in a mouth configured to receive the hand and wrist therethrough. The wrist-receiving part includes a slot therein which extends from the mouth toward the palm compartment. A pneumatic wrap contacts at least a part of each side of the slot for urging the sides of the slot together when inflated.

Preferably, one end of the pneumatic wrap is coupled adjacent one side of the slot, crosses the slot a first time, extends around the wrist-receiving part, crosses the slot a second time, and is coupled adjacent the other side of the slot. Preferably, the pneumatic wrap is wound in a spiral around the wrist-receiving part. However, the pneumatic wrap can have the form of a sleeve configured to be received around the wrist-receiving part. The pneumatic wrap can be received on an outside surface of the wrist-receiving part, an inside surface of the wrist-receiving part or inside the wrist-receiving part. The pneumatic wrap includes an inflatable bladder for receiving and retaining gas therein and a gas inlet means for admitting gas into the inflatable bladder. The gas inlet means can include a gas inlet port configured to receive a conventional needle valve or a diaphragm pump formed integrally with the boxing glove. The pneumatic wrap can also include a cover covering an exposed side of the inflatable bladder.

I have also invented a boxing glove that includes a glove body defining a hand-receiving part for receiving a hand enclosed therein and a wrist-receiving part in communication with the hand-receiving part. The wrist-receiving part has a mouth opposite the hand-receiving part. The wrist-receiving part is configured to enable the hand to pass therethrough between the hand-receiving part and the mouth. The wrist-receiving part is configured to enclose the wrist of the hand when the hand is received in the hand-receiving part. A slot is formed in the wrist-receiving part. The slot defines a pair of opposed sides which extend from the mouth toward the hand-receiving part. In one embodiment, a pneumatic wrap is coupled to the wrist-receiving part adjacent each opposite sides of the slot. The pneumatic wrap is wound around the wrist-receiving part between the coupling thereof adjacent each opposed side of the slot and crosses the slot at least one time. In another embodiment, the pneumatic wrap has a tubular form with an inside diameter configured to receive the wrist-receiving part therein when the pneumatic wrap is deflated. In each case, the pneumatic wrap urges the opposed sides together when it is inflated.

DETAILED DESCRIPTION OF THE PREFERRED EMBODIMENTS

Figure 1A:
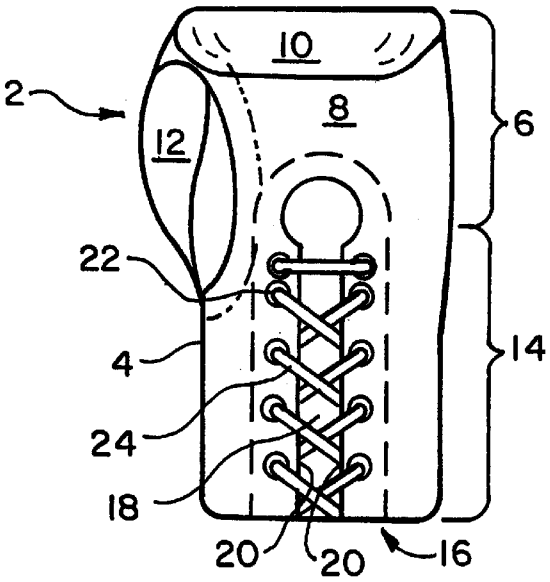
FIG. 1*a* is a plan view of a palm side of a prior art boxing glove with a lace loosened to permit receipt of a hand therein.
Figure 1B:
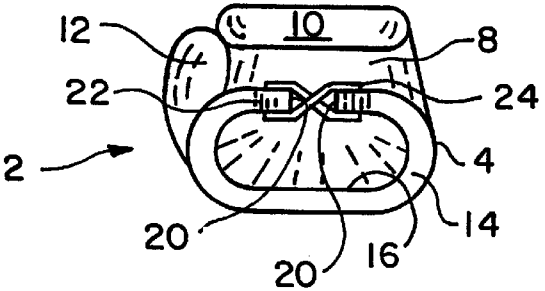
FIG. 1*b* is an end view of the wrist-receiving part of the boxing glove of FIG. 1*a;*

With reference to FIGS. 1*a* and 1*b*, a conventional prior art boxing glove 2 includes a glove body 4 having a hand-receiving part 6 which includes a palm compartment 8, a finger compartment 10 and a thumb compartment 12. The palm compartment 8 is configured to receive and enclose a palm part and a dorsal part of a hand. The finger compartment 10 and the thumb compartment 12 are configured to receive and separately enclose the respective fingers and thumb of the hand.

An elongated wrist-receiving part 14 extends away from a side of the palm compartment 8 opposite the finger compartment 10 and terminates in a mouth 16 which is configured to receive the hand and wrist therethrough. The wrist-receiving part 14 includes a slot 18 defined by a pair of opposed sides 20 which extend from mouth 16 and terminate on or adjacent hand-receiving part 6. A plurality of eyelets 22 are arranged in wrist-receiving part 14 adjacent each opposed side 20. Eyelets 22 are configured to receive a lace or string 24 therethrough in a manner known in the art.

In order to place a hand and a wrist into glove body 4, lace 24 is loosely received through eyelets 22 so that opposed sides 20 can separate to admit the hand and wrist therethrough.

Figure 2A:
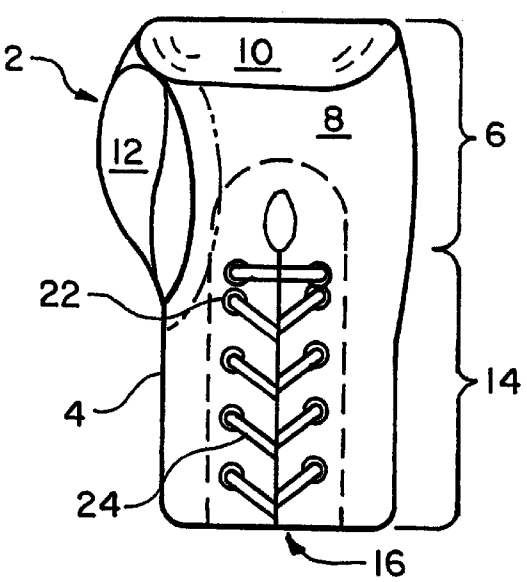
FIG. 2*a* is the boxing glove of FIG. 1*a* with the lace tightened.
Figure 2B:
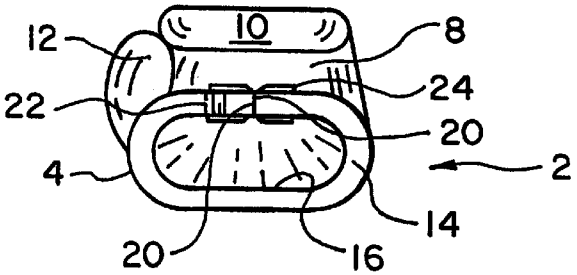
FIG. 2b (PRIOR ART)
FIG. 2*b* is an end view of the wrist-receiving part of the boxing glove of FIG. 2*a;*

With reference to FIGS. 2*a* and 2*b*, and with ongoing reference to FIGS. 1*a* and 1*b*, once the hand and wrist are received in the respective hand-receiving part 6 and wrist-receiving part 14, tension is applied to opposite ends of lace 24 in a manner known in the art to urge opposed sides 20 together, preferably touching. Thereafter, the ends of lace 24 are tied together in a manner known in the art and tape, preferably surgical tape, is wrapped around the wrist-receiving part 14 to further secure boxing glove 2 to the hand as well as to secure lace 24 adjacent glove body 4.

A problem with a conventional boxing glove 2 is that the tape often becomes loose during a boxing event thereby necessitating a temporary stop to the event to re-secure the tape. Moreover, when the tape becomes loose, it is possible that a loose part of the tape or a loose part of lace 24 can contact an opponent's eye during the boxing match with a possibility of injury to the eye.

Having described the prior art, the present invention will now be described with reference to FIGS. 3*a*–11 and 13*a*–13*c*, where like reference numbers correspond to like elements. In FIGS. 3*a*–11 and 13*a*–13*c*, the prime (') or double prime (") superscript is used to distinguish various embodiments of the invention where the same reference numbers are used in connection with like elements.

Figure 3A:
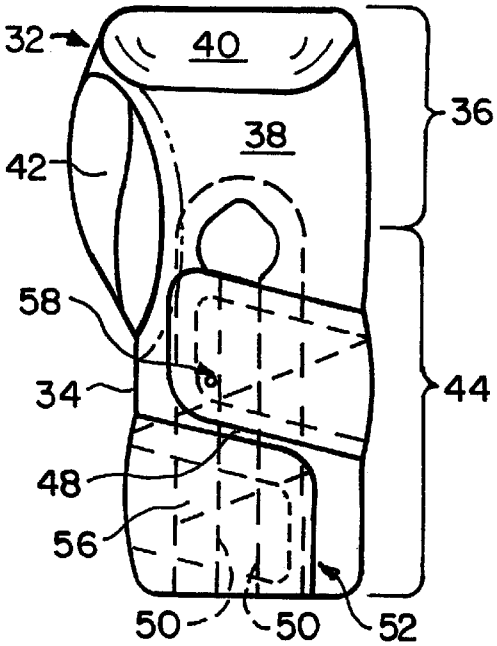
FIG. 3*a* is a plan view of the palm side of a boxing glove including a deflated pneumatic wrap in accordance with the present invention.
Figure 3B:
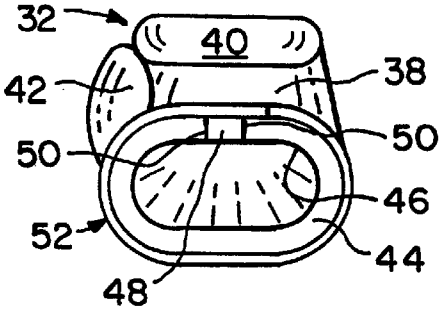
FIG. 3*b* is an end view of the wrist-receiving part of the boxing glove of FIG. 3*a;*
Figure 8:
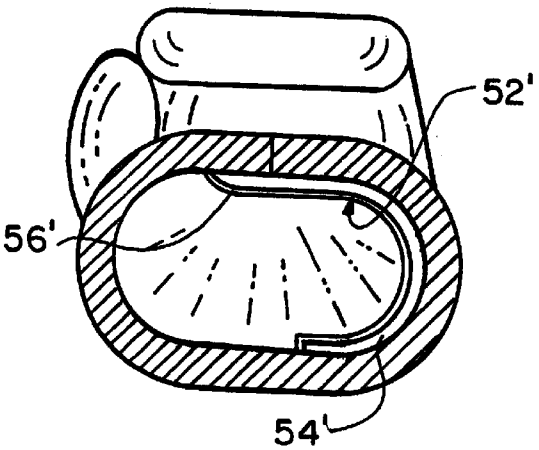
FIG. 8 is a view of the boxing glove of FIG. 7*a* taken along line VIII—VIII.
Figure 7A:
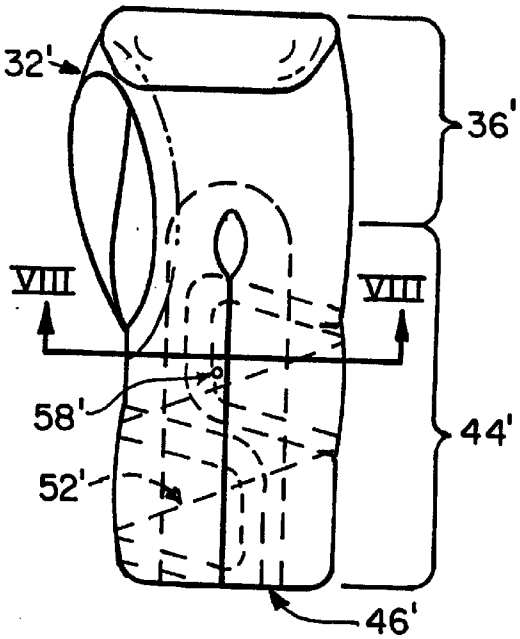
FIG. 7*a* is a plan view of the wrist-receiving part of the boxing glove of FIG. 6*a* with the pneumatic wrap inflated.
Figure 7B:
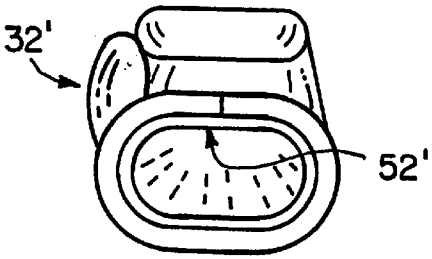
FIG. 7*b* is an end view of the wrist-receiving part of the boxing glove of FIG. 7*a;*
Figure 6A:
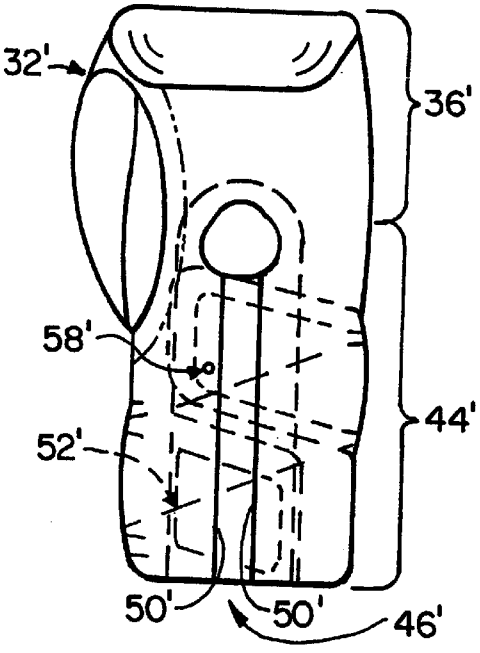
FIG. 6*a* is a plan view of the palm side of a boxing glove including a deflated pneumatic wrap received on an inside surface of the wrist-receiving part of the boxing glove.
Figure 6B:
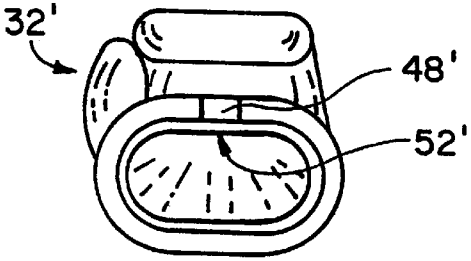
FIG. 6*b* is an end view of the wrist-receiving part of the boxing glove in FIG. 6*a;*
Figure 11:
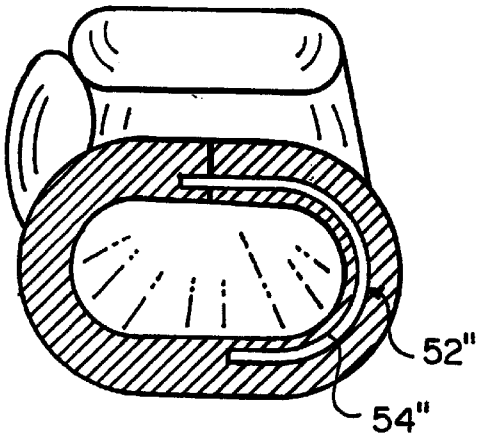
FIG. 11 is a view of the boxing glove of FIG. 10*a* taken along line XI—XI.
Figure 10A:
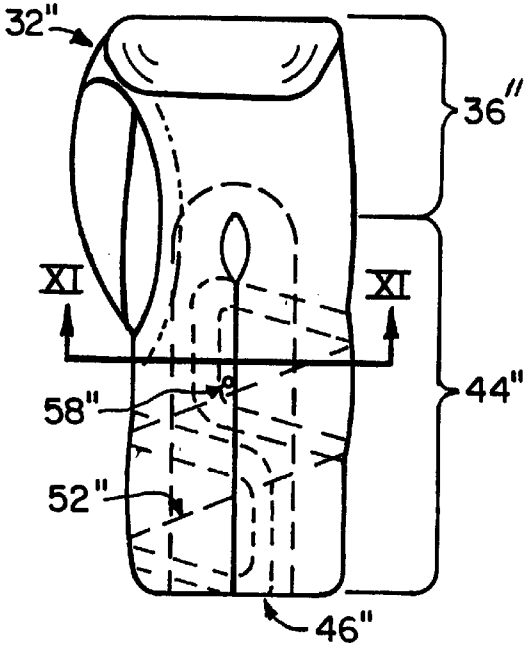
FIG. 10*a* is a plan view of the boxing glove of FIG. 9*a* with a pneumatic wrap inflated.
Figure 10B:
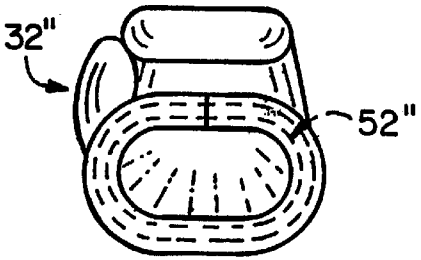
FIG. 10*b* is an end view of the wrist-receiving part of the boxing glove of FIG. 10*a;*
Figure 9A:
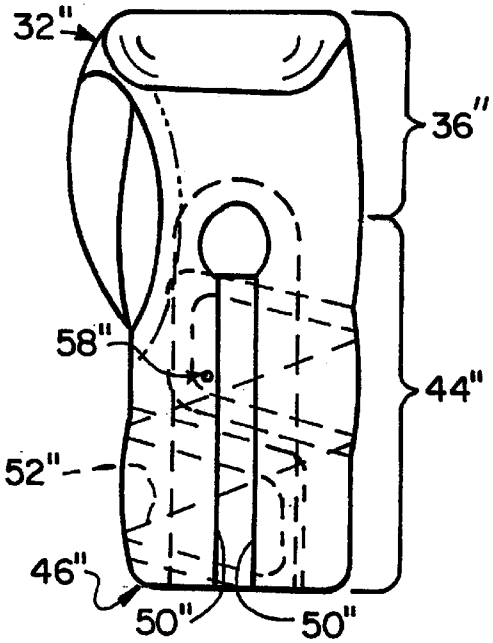
FIG. 9*a* is a plan view of the palm side of a boxing glove including a deflated pneumatic wrap received in the wrist-receiving part of the boxing glove.
Figure 9B:
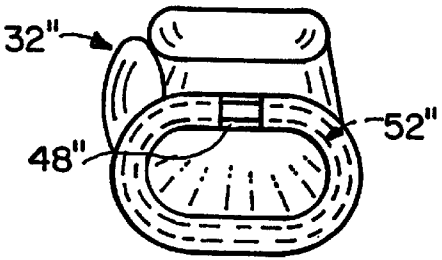
FIG. 9*b* is an end view of the wrist-receiving part of the boxing glove of FIG. 9*a;*

In FIGS. 3*a* and 3*b*, a boxing glove 32 in accordance with the present invention includes a glove body 34 having a hand-receiving part 36 which includes a palm compartment 38, a finger compartment 40 and a thumb compartment 42. Hand-receiving part 36, palm compartment 38, finger compartment 40 and thumb compartment 42 correspond to like named elements 6, 8, 10 and 12, respectively, of boxing glove 2. A wrist-receiving part 44 extends away from a side of the palm compartment 38 opposite finger compartment 40 and terminates in a mouth 46 which is configured to receive the hand and wrist therethrough. Wrist-receiving part 44 is configured to receive and enclose the wrist of the hand received in the hand-receiving part 36. Wrist-receiving part 44 includes therein a slot 48 defined by a pair of opposed sides 50 which extend from mouth 46 toward hand-receiving part 36. Wrist-receiving part 44, mouth 46, slot 48 and opposed sides 50 correspond to like named elements 14, 16,.18 and 20, respectively, of boxing glove 2.

A pneumatic wrap 52 is coupled to wrist-receiving part 44 adjacent each opposed side 50 of slot 48. The pneumatic wrap 52 is wound around wrist-receiving part 44 between the coupling thereof adjacent each opposed side 50 of slot 48 and crosses slot 48 at least one time. More particularly, one end of pneumatic wrap 52 is coupled to wrist-receiving part 44 adjacent one side of slot 48. Thereafter, pneumatic wrap 52 crosses slot 48 a first time, extends around wrist-receiving part 44 and crosses slot 48 a second time where the other end of pneumatic wrap 52 is coupled to wrist-receiving part 44 adjacent the other side of slot 48. Preferably, pneumatic wrap 52 is wound in a spiral.

Figure 4A:
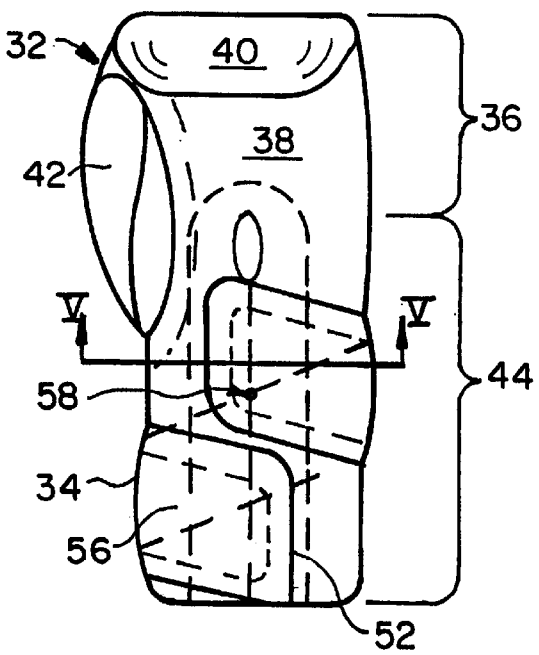
FIG. 4*a* is a plan view of the boxing glove of FIG. 3*a* with the pneumatic wrap inflated.
Figure 4B:
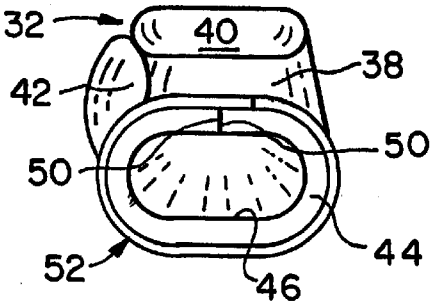
FIG. 4*b* is an end view of the wrist-receiving part of the boxing glove of FIG. 4*a;*

Pneumatic wrap 52 is configured so that when deflated, opposed sides 50 can separate thereby enabling a hand to pass therethrough between hand-receiving part 36 and mouth 46. When the hand is received in hand-receiving part 36, a gas, such as air, is admitted into pneumatic wrap 52 via a gas inlet means 58. As shown in FIGS. 4*a* and 4*b*, when inflated, pneumatic wrap 52 urges opposed sides 50 together thereby securing boxing glove 32 to the hand and wrist.

Figure 5:
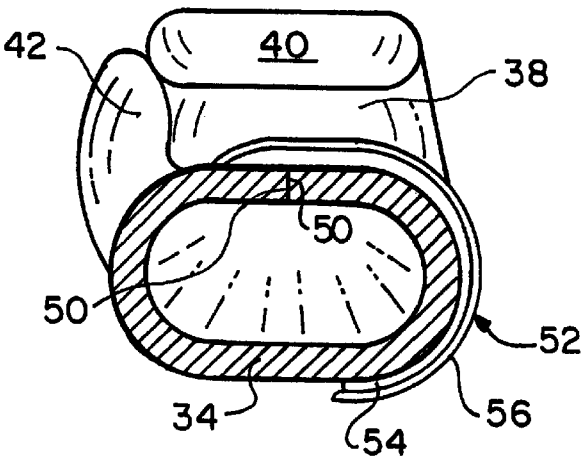
FIG. 5 is a view of the boxing glove of FIG. 4*a* taken along line V—V.

With reference to FIG. 5, and with ongoing reference to FIGS. 3*a*–4*b*, pneumatic wrap 52 preferably includes an inflatable bladder 54 sandwiched between an outside surface of wrist-receiving part 44 and a cover 56, preferably a leather cover, which covers bladder 54. To permit inflation of inflatable bladder 54, gas inlet means 58 is in fluid communication therewith.

In the embodiment of boxing glove 32' shown in FIGS. 6*a*–8, pneumatic wrap 52' includes an inflatable bladder 54' sandwiched between an inside surface of wrist-receiving part 44' and a cover 56' disposed inside wrist-receiving part 44'. In this embodiment, a gas inlet means 58' is coupled in fluid communication between inflatable bladder 54' and an exterior of wrist-receiving part 44' adjacent one side of slot 48'.

Another embodiment of boxing glove 32" in accordance with the present invention is shown in FIGS. 9*a*–11. In this embodiment, pneumatic wrap 52" is sandwiched inside the wrist-receiving part 44" between the inside and outside surfaces thereof, with each end of pneumatic wrap 52" coupled to a different side 50" of slot 48". Preferably, at least adjacent slot 48", pneumatic wrap 52" is slidably received in wrist-receiving part 44". The slidable arrangement of pneumatic wrap 52" in wrist-receiving part 44" enables opposed sides 50" to separate in response to a hand passing through wrist-receiving part 44" when pneumatic wrap 52" is deflated. The slidable arrangement of pneumatic wrap 52∴ in wrist-receiving part 44" also enables opposed sides 50" of slot 48" to move together when pneumatic wrap 52" is inflated.

Pneumatic wrap 52" includes a gas inlet means 58" which is preferably in fluid communication with an inflatable bladder 54" and an outside surface of wrist-receiving part 44" for admitting gas into inflatable bladder 54".

Figure 12:
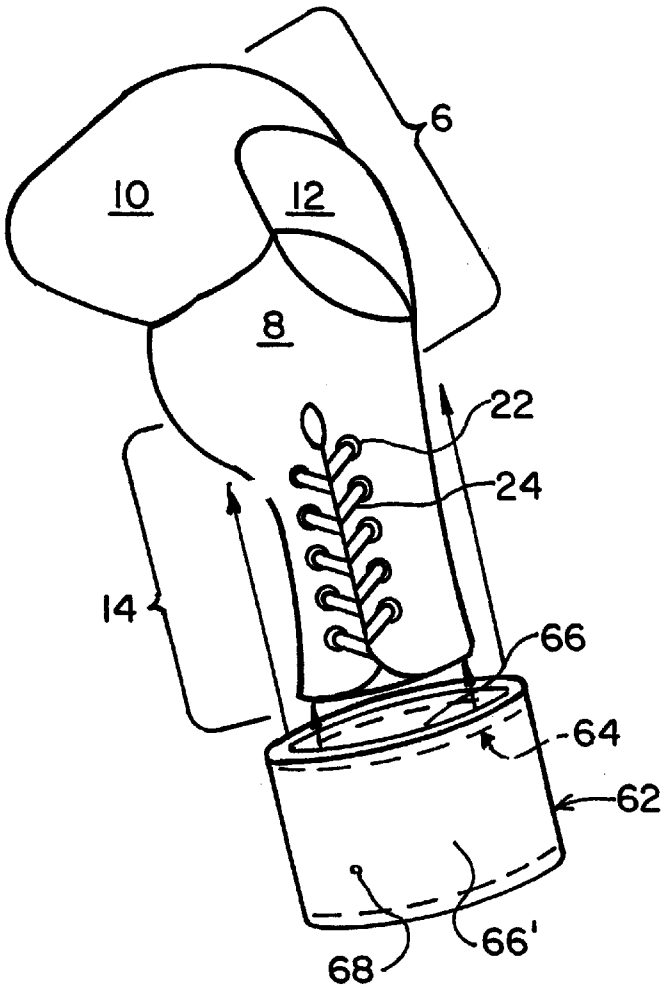
FIG. 12 is a mirror image perspective view of the conventional boxing glove shown in FIG. 2*a* including a tubular or sleeve like pneumatic wrap.

In another embodiment of the present invention, shown in FIG. 12, a tubular or sleeve-like pneumatic wrap 62 has an inside diameter configured to receive the wrist-receiving part 14 of convention boxing glove 2. Pneumatic wrap 62 includes an inflatable bladder 64 (shown in phantom) which is preferably sandwiched between an inside cover 66 and an outside cover 66'. Pneumatic wrap 62 includes a gas inlet means 68 connected between inflatable bladder 64 and the outside cover 66' for admitting gas into inflatable bladder 64.

Figure 13A:
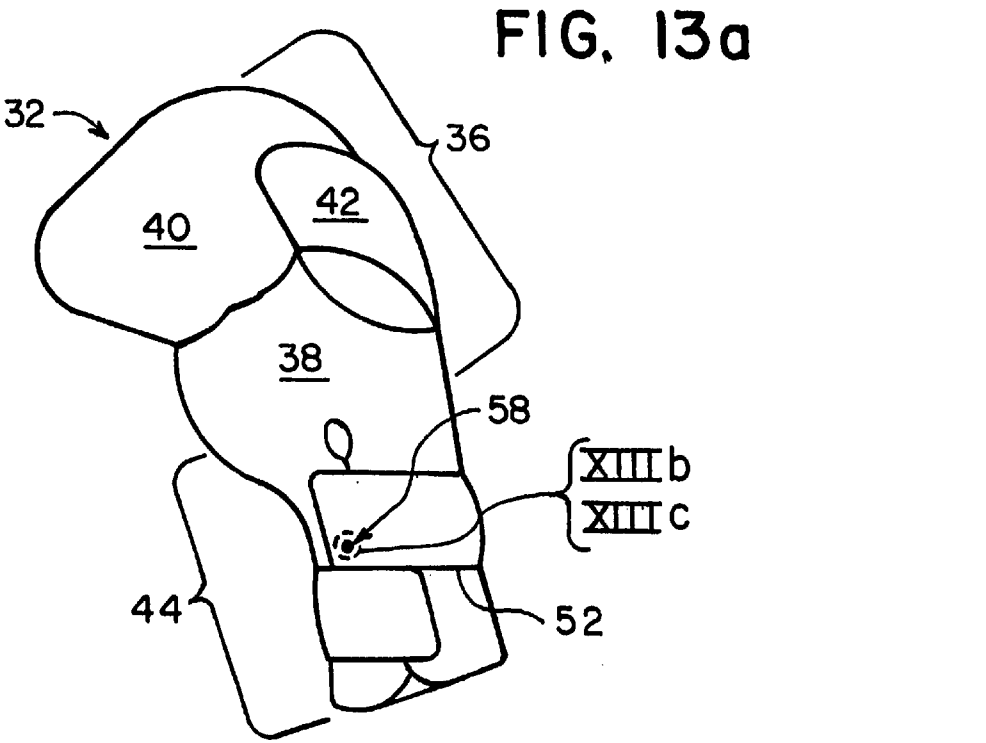
FIG. 13*a* is mirror image perspective view of the boxing glove of FIG. 3*a;*
Figure 13B:
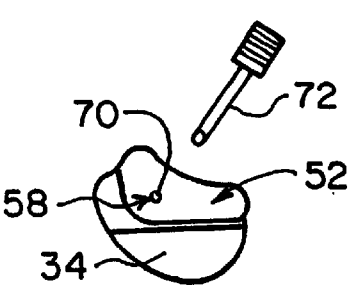
FIG. 13*b* is an enlarged view of one embodiment of the gas inlet means of FIG. 13*a*.
Figure 13C:
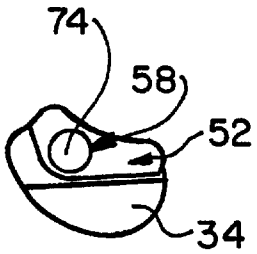
FIG. 13*c* is an enlarged view of another embodiment of the gas inlet means of FIG. 13*a*.

FIG. 13*a* shows a mirror image perspective view of the boxing glove 32 shown in FIG. 3*a*. FIG. 13*b* shows a close-up view of the gas inlet means 58 of the pneumatic wrap 52 shown in FIG. 13*a*. The gas inlet means 58 shown in FIG. 13*b* includes a gas inlet port 70 configured to fluidly mate with a conventional needle valve 72. The gas inlet port 70 is the same as the gas inlet port typically found on an inflatable ball, such as a football, soccer ball, etc. In FIG. 13*c*, gas inlet means 58 is a diaphragm pump 74 of the type typically found on certain inflatable tennis shoes. Diaphragm pump 74 provides a completely integrated solution eliminating the need for needle valve 72 and an external air pump. Gas inlet means 68 in FIG. 12 can also include gas inlet port 70 or diaphragm pump 74.

As can be seen, the present invention provides a means for securing a boxing glove to a hand and wrist while avoiding the problems of loose tape and/or loose lace common to conventional prior art boxing gloves.

The present invention has been described with reference to the preferred embodiments. Obvious modifications and alterations will occur to others upon reading and understanding the preceding detailed description. It is intended that the invention be construed as including all such modifications and alterations insofar as they come within the scope of appended claims or the equivalents thereof.

I claim:

1. A boxing glove comprising:

a hand part having a palm compartment in communication with a finger compartment and a thumb compartment, the plan compartment configured to receive and enclose a palm part and a dorsal part of a hand, the finger compartment and the thumb compartment configured to receive and separately enclose the respective fingers and thumb of the hand;

an elongated wrist-receiving part configured to receive and enclose a wrist of the hand received in the hand part, the wrist-receiving part extending away from a side of the palm compartment opposite the finger compartment and terminating in a mouth configured to receive the hand and wrist therethrough, the wrist-receiving part having a slot therein which extends from the mouth toward the palm compartment; and a pneumatic wrap contacting at least a part of each side of the wrist-receiving part of the slot for urging the sides of the slot together when inflated.

2. The boxing glove as set forth in claim 1, wherein the pneumatic wrap:

is coupled adjacent one side of the slot;

crosses the slot a first time;

extends around the wrist-receiving part;

crosses the slot a second time; and is coupled adjacent the other side of the slot.

3. The boxing glove as set forth in claim 2, wherein the pneumatic wrap is wound in a spiral around the wrist-receiving part.

4. The boxing glove as set forth in claim 2, wherein the pneumatic wrap is received (i) on an outside surface of the wrist-receiving part, (ii) an inside surface of the wrist-receiving part, or (iii) inside the wrist-receiving part.

5. The boxing glove as set forth in claim 1, wherein the pneumatic wrap has the form of a sleeve configured to be received around the wrist-receiving part.

6. The boxing glove as set forth in claim 1, wherein the pneumatic wrap includes an inflatable bladder for receiving and retaining gas therein and a gas inlet means for admitting gas into the inflatable bladder.

7. The boxing glove as set forth in claim 6, wherein the gas inlet means includes at least one of(i) a gas inlet port configured to receive a needle valve and (ii) a diaphragm pump formed integral with the boxing glove.

8. The boxing glove as set forth in claim 6, wherein the pneumatic wrap further includes a cover covering an exposed side of the inflatable bladder.

9. A boxing glove comprising:

a glove body defining a hand-receiving part for receiving a hand enclosed therein and a wrist-receiving part in communication with the hand-receiving part, the wrist-receiving part having a mouth opposite the hand-receiving part, the wrist-receiving part configured to enable the hand to pass therethrough between the hand-receiving part and the mouth, the wrist-receiving part configured to enclose the wrist when the hand is received in the hand-receiving part;

a slot formed in the wrist-receiving part, the slot defining a pair of opposed sides which extend from the mouth toward the hand-receiving part; and a pneumatic wrap coupled to the wrist-receiving part adjacent each opposed side of the slot, the pneumatic wrap wound around the wrist-receiving part between the coupling thereof adjacent each opposed side of the slot and crossing the slot at least one time, wherein the pneumatic wrap urges the opposed sides together when inflated.

10. The boxing glove as set forth in claim 9, wherein the pneumatic wrap is wound in a spiral.

11. The boxing glove as set forth in claim 9, wherein the pneumatic wrap crosses the slot at least two times.

12. The boxing glove as set forth in claim 9, wherein the pneumatic wrap is received (i) on an outside surface of the wrist-receiving part, (ii) an inside surface of the wrist-receiving part, or (iii) inside the wrist-receiving part.

13. The boxing glove as set forth in claim 10, wherein the pneumatic wrap includes an inflatable bladder for receiving and retaining gas therein and a gas inlet means for admitting gas into the inflatable bladder.

14. The boxing glove as set forth in claim 13, wherein the gas inlet means includes at least one of (i) a gas port configured to receive a needle valve and (ii) a diaphragm pump formed integral with the boxing glove.

15. The boxing glove as set forth in claim 13, wherein the pneumatic wrap further includes a cover covering an exposed side of the inflatable bladder.

16. A boxing glove comprising:

a glove body defining a hand-receiving part for receiving a hand enclosed therein and a wrist-receiving part in communication with the hand-receiving part, the wrist-receiving part having a mouth opposite the hand-receiving part, the wrist-receiving part configured for allowing the hand to pass therethrough between the hand-receiving part and the mouth, the wrist-receiving part configured to enclose the wrist of the hand when the hand is received in the hand-receiving part;

a slot formed in the wrist-receiving part, the slot defining a pair of opposed sides which extend from the mouth toward the hand-receiving part; and a pneumatic wrap having a tubular form with an inside diameter configured to receive the wrist-receiving part therein when the pneumatic wrap is deflated, wherein the pneumatic wrap urges the opposed sides together when it is inflated.

17. The boxing glove as set forth in claim 16, wherein the pneumatic wrap is received (i) on an outside surface of the wrist-receiving part, (ii) an inside surface of the wrist-receiving part, or (iii) inside the wrist-receiving part.

18. The boxing glove as set forth in claim 16, wherein the pneumatic wrap includes an inflatable bladder for receiving and retaining gas therein and a gas inlet means for admitting gas into the inflatable bladder.

19. The boxing glove as set forth in claim 18, wherein the gas inlet means includes at least one of (i) a gas inlet port configured to receive a needle valve and (ii) a diaphragm pump formed integral with the boxing glove.

20. The boxing glove as set forth in claim 18, wherein the pneumatic wrap further includes a cover covering an exposed side of the inflatable bladder.

* * * * *

UNITED STATES PATENT AND TRADEMARK OFFICE

CERTIFICATE OF CORRECTION

PATENT NO. : 6,202,213 B1
DATED : March 20, 2001
INVENTOR(S) : John J. Georgick

It is certified that error appears in the above-identified patent and that said Letters Patent is hereby corrected as shown below:

Column 1,
Line 7, between "Serial" and "No." delete period (.)
Line 25, "opponents face" should read -- opponent' face --.
Line 32, "oppenents face" should read -- opponent's face --.

Column 4,
Line 29, "16,."18" should read -- 16, 188 -- (delete period).

Column 5,
Line 10, "52.·." should read -- 52" --.
Line 57, Claim 1, "plan compartment" should read -- palm compartment --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*